US010483671B2

(12) United States Patent
Funke

(10) Patent No.: US 10,483,671 B2
(45) Date of Patent: Nov. 19, 2019

(54) ELECTRICAL PLUG-IN CONNECTOR, PRINTED CIRCUIT BOARD AND METHOD FOR PRODUCING AN ELECTRICAL PLUG-IN CONNECTOR

(71) Applicant: Phoenix Contact GmbH & Co. KG, Blomberg (DE)

(72) Inventor: Christian Funke, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/106,019

(22) Filed: Aug. 21, 2018

(65) Prior Publication Data

US 2019/0097337 A1 Mar. 28, 2019

(30) Foreign Application Priority Data

Aug. 21, 2017 (BE) ..... 2017/5575

(51) Int. Cl.

| | |
|---|---|
| ***H01R 12/72*** | (2011.01) |
| ***H01R 13/26*** | (2006.01) |
| ***H01R 13/41*** | (2006.01) |
| ***H01R 12/70*** | (2011.01) |
| ***H01R 43/02*** | (2006.01) |
| *H01R 12/58* | (2011.01) |
| *H01R 12/71* | (2011.01) |

(52) U.S. Cl.

CPC ..... *H01R 12/724* (2013.01); *H01R 12/707* (2013.01); *H01R 13/26* (2013.01); *H01R 13/41* (2013.01); *H01R 43/0256* (2013.01); *H01R 12/58* (2013.01); *H01R 12/714* (2013.01)

(58) Field of Classification Search

CPC ..... H01R 12/724; H01R 13/40; H01R 13/41; H01R 15/28

USPC ..... 439/83

See application file for complete search history.

(56) References Cited

U.S. PATENT DOCUMENTS 5,154,627 A * 10/1992 Lee ..... H01R 12/7005 439/326

5,667,392 A * 9/1997 Kocher ..... H01R 13/26 439/733.1

(Continued)

FOREIGN PATENT DOCUMENTS

DE 202006016424 U1 1/2007

EP 2947720 A1 11/2015

*Primary Examiner* — Alexander Gilman

(74) *Attorney, Agent, or Firm* — Leydig, Voit & Mayer, Ltd.

(57) ABSTRACT

An electrical plug-in connector for interconnecting contacts of a first contact carrier and of a second contact carrier includes: an electrical connector element that is inserted in a chamber in a housing body when in an inserted position, such that the electrical connector element forms, on a first connection side of the housing body, a first electrical contact portion for plug-in connection to the contact of the first contact carrier and, on a second connection side of the housing body, a second electrical contact portion for connection to the contact of the second contact carrier. The electrical connector element is inserted at least in portions into the chamber via a side insertion opening when in the inserted position. The electrical connector element includes at least one clamping slot for being held on the housing body, which slot is open towards an outer edge of the electrical connector element.

21 Claims, 7 Drawing Sheets

(56) References Cited

U.S. PATENT DOCUMENTS

| | | | | |
|---|---|---|---|---|
| 6,276,942 | B1 * | 8/2001 | Hsiao | H01R 13/26 439/74 |
| 8,366,458 | B2 * | 2/2013 | Ngo | H01R 12/724 439/79 |
| 8,926,341 | B2 * | 1/2015 | Chen | H01R 12/7088 439/79 |
| 9,136,645 | B1 * | 9/2015 | Yu | H01R 12/7088 |
| 9,537,242 | B2 * | 1/2017 | Chen | H01R 13/18 |
| 9,537,253 | B2 * | 1/2017 | Zhao | H01R 13/5837 |
| 9,543,688 | B2 * | 1/2017 | Pao | H01R 4/02 |
| 9,853,403 | B1 * | 12/2017 | Chen | H01R 12/716 |
| 9,954,312 | B1 * | 4/2018 | Ju | H01R 12/707 |
| 10,230,178 | B2 * | 3/2019 | Droesbeke | H01R 13/11 |
| 2008/0102712 | A1 * | 5/2008 | Giefers | H01R 13/514 439/733.1 |

* cited by examiner

ELECTRICAL PLUG-IN CONNECTOR, PRINTED CIRCUIT BOARD AND METHOD FOR PRODUCING AN ELECTRICAL PLUG-IN CONNECTOR

CROSS-REFERENCE TO PRIOR APPLICATION

Priority is claimed to Belgian Patent Application No. BE2017/5575, filed on Aug. 21, 2017, the entire disclosure of which is hereby incorporated by reference herein.

FIELD

The invention relates to an electrical plug-in connector, to a printed circuit board comprising an electrical plug-in connector arranged thereon, and to a method for producing an electrical plug-in connector.

BACKGROUND

Electrical plug-in connectors of the type in question are used for electrical or signal connection between contacts of a first contact carrier and of a second contact carrier. Contact carriers may be formed, for example, by plugs, couplings or sockets that have a contact or a plurality of electrical contacts.

Electrical plug-in connectors of the type in question are known, for example, from DE 20 2006 016424 U1 and are equipped with at least one electrical connector element for the purpose of electrically interconnecting contacts as mentioned above, which connector element is inserted at least portions in a chamber in a housing body when in an inserted position.

When in an inserted position, the at least one electrical connector element is inserted in the chamber such that the electrical connector element forms, on a first connection side of the housing body, a first electrical contact portion for plug-in connection to the contact of the first contact carrier and, on a second connection side of the housing body, a second electrical contact portion for connection to the contact of the second contact carrier.

SUMMARY

In an embodiment, the present invention provides an electrical plug-in connector for interconnecting contacts of a first contact carrier and of a second contact carrier, comprising: an electrical connector element that is inserted in a chamber in a housing body when in an inserted position, such that the electrical connector element forms, on a first connection side of the housing body, a first electrical contact portion for plug-in connection to the contact of the first contact carrier and, on a second connection side of the housing body, a second electrical contact portion for connection to the contact of the second contact carrier, wherein the electrical connector element is inserted at least in portions into the chamber via a side insertion opening when in the inserted position and comprises at least one clamping slot for being held on the housing body, which slot is open towards an outer edge of the electrical connector element and which is configured such that the electrical connector element is clampingly placed on a housing rib of the housing body by the clamping slot.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
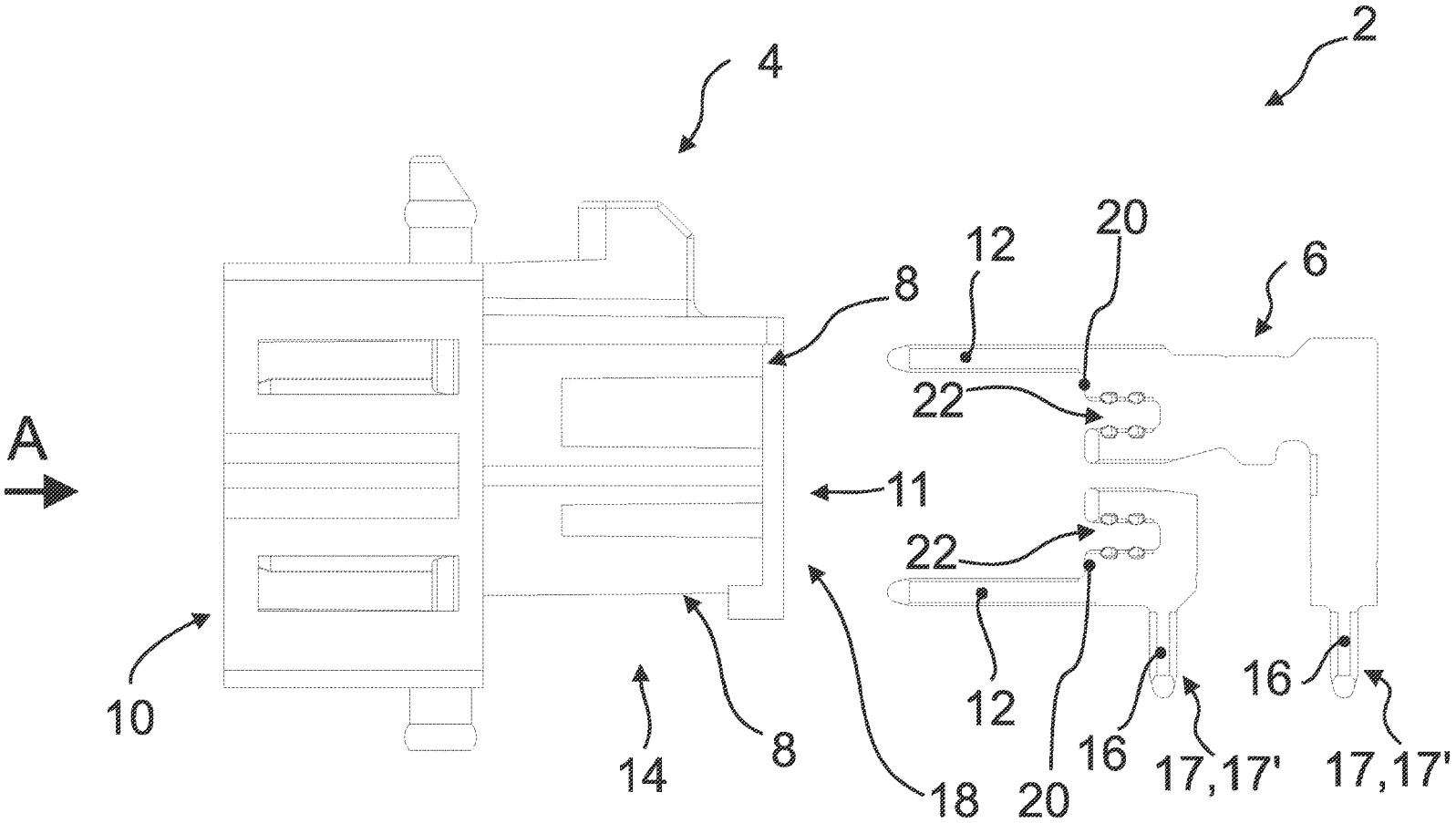
FIG. 1 is schematic side view of an embodiment of an electrical plug-in connector according to the invention, in which view the housing body and the electrical connector element are separated from one another.

An aspect of the present invention moves away from the concept of adjusting the housing body, with regard to improved accessibility of the chamber, for the arrangement an electrical connector element. A concept of the invention therefore avoids having to assemble the housing body from individual segments, for example in the manner of a sandwich assembly, as a result of which the necessary electrical connector element(s) is/are inserted into the housing body in layers and in particular one after the other.

In an embodiment, the invention provides a plug-in connector of the type in question, the electrical connector element being inserted at least in portions into the chamber via a side insertion opening when in an inserted position and comprising at least one clamping slot which is open towards an outer edge of the electrical connector element and by means of which the electrical connector element is clampingly placed on a housing rib of the housing body when in an inserted position and is thus force-lockingly held on the housing body.

The method for producing the plug-in connector makes it possible to improve insertion and retention of the connector element in the chamber provided therefor in the housing body by simplifying the insertion process. In addition, the invention pursues the concept of achieving a secure hold of the connector element on the housing body.

For this purpose, according to the invention a clamping action is achieved in an inserted position on account of interaction between the clamping slot and the housing rib, which clamping action brings about a clamping force for holding the electrical connector element on the housing body. For this purpose, the clamping slot and the housing rib interact in an inserted position such that a clamping force arises that causes the electrical connector element to be held on the housing body. In the process, the electrical connector element presses on the housing rib by means of the clamping slot such that a compressive force or clamping force acts therebetween that causes the electrical connector element to be held on the housing body.

Additional aids are therefore advantageously not necessary to hold the connector element on the housing body in the above-mentioned manner.

The clamping force is generated by the opposite edges of the clamping slot, between which the housing rib is arranged at least in portions in an inserted position, pressing on the housing rib. This is achieved in particular by the distance between the edges and thus the width of the clamping slot being smaller in the non-loaded state than the corresponding width of the housing rib.

Within the scope of the invention, a non-loaded state is distinguished in that a clamping force is not acting between the connector element and the housing rib. In the non-loaded state, the connector element is therefore not placed on the housing rib by means of the clamping slot and is therefore not in an inserted position.

According to the invention, the width of the housing rib or the width of the clamping slot is measured orthogonally to the longitudinal extension of the clamping slot or the housing rib, along which extension the clamping slot is placed on the housing rib and placed in an inserted position.

Within the scope of the description of the invention, statements made about an electrical plug-in connector formed according to the invention are in principle based on an inserted position in which the electrical connector element is arranged in the chamber provided therefor in the housing body and is clampingly placed, by means of clamping slot, on the housing rib provided therefor. The electrical connector element here is inserted and arranged at least in portions in the chamber provided therefor in the housing body. Departures from this are explicitly mentioned or emerge directly from the context.

Within the context of the invention, the terms "extends longitudinally" or "longitudinal extension" in relation to the clamping slot are understood to mean an extension that is oriented towards the outer edge of the connector element. According to the invention, an outer edge of the connector element is understood to mean a peripheral boundary of the connector element.

Within the meaning of the invention, the chamber provided for the connector element is designed, for example, in particular as a portion in the housing body that is delimited by housing walls and the like, as a result of which reliable galvanic separation, for example from further connector elements or electrical components/elements, is facilitated.

According to the invention, however, a plurality of connector elements which may also be interconnected may also be arranged in a chamber. In addition, said connector elements may be separated from one another such that mutual electrical insulation is achieved on account of the distance therebetween.

Within the scope of the invention, a housing rib on which the connector element is placed by means of the clamping slot may be designed in various ways to interact with the clamping for a force-locking hold.

Preferably, the above-mentioned housing rib of the housing body for the clamping slot of the connector element is elongate and extends longitudinally in the same direction in which the electrical connector element is placed on the housing rib by means of the clamping slot.

Within the scope of the invention, the chamber in the housing body is configured and designed such that the first and the second contact portion of the connector element are accessible for contacting corresponding contacts of a relevant contact carrier.

In the case of an electrical plug-in connector according to the invention, an insertion opening for inserting an electrical connector element into the chamber in the housing body may be formed in various ways. Preferably, the insertion opening is formed in the manner of a slot via which the electrical connector element can be inserted into the chamber.

Within the scope of the invention, a side insertion opening is understood to mean an opening that is formed on one of the connection sides or on a side of the housing body opposite the first or second connection side.

The formation of a side insertion opening on one of the sides opposite the connection sides brings about the advantage that the connection sides for the contacting and the insertion opening that is separate therefrom can be optimally designed for inserting the electrical connector element.

Therefore, in an advantageous development of the invention, the side insertion opening is formed on a side of the housing body opposite the first or second connection side.

To transmit electrical currents or signals, according to the invention the first electrical contact portion and the second electrical contact portion are interconnected by means of a sheet-like connection portion. The advantage of this is that the connection element has a flat design and the dimensions of the chamber for the electrical connector element can therefore be kept low, resulting in a space saving. This makes it possible for the dimensions of an electrical plug-in connector formed according to the invention to be kept low. Within the scope of the invention, the sheet-like connection portion does not necessarily have to be flat, but rather may also have elevations, recesses, bends, curved planar portions or deformations. Preferably, however, the sheet-like connection portion is flat; as a result, a sheet-like connection portion facilitates high production accuracy and a low space requirement.

According to the invention, the connector element in the chamber may be arranged in various ways. It is therefore not absolutely essential that the electrical connector element be completely arranged or accommodated in the chamber. In this regard, the scope of the invention includes the above-mentioned connection portion being arranged or accommodated at least in portions, in particular predominantly, preferably completely, in the chamber, as in a further, advantageous development of the invention.

To achieve further advantages, according to the invention the electrical connector element is formed of just one element. To that effect, in an advantageous development of the invention the electrical connector element is formed in one piece, in particular as a punched part made of an electrically conductive metal, in particular made of electrically conductive sheet metal or an electrically conductive metal sheet; in addition to high electrically conductivity, this results in simple, cost-effective production. This also leads to a rigid structure that ensures easier handling of the electrical connector element when it is inserted into the chamber in the housing body, in comparison with an electrical connector element formed of a bent wire. Within the scope of the invention, the electrical connector element may also have a surface coating, surface textures, embossed portions and the like at least in portions.

To further simplify an electrical connector element formed according to the invention, in a further advantageous development of the invention the clamping slot is formed in the sheet-like connection portion. In this respect, the above-mentioned advantage therefore applies accordingly to the formation of the clamping slot.

The number of necessary elements for producing an electrical plug-in connector according to the invention can therefore be kept to a minimum; in addition to cost and logistics advantages, this results in advantages in terms of simple handling when a plug-in connector according to the invention is produced.

The design of the electrical connector element makes it possible to keep the dimensions of the necessary installation space for an electrical connector element, together with the clamping slot therein, to a minimum.

If a plurality of electrical connector elements is used on the housing body, said elements may be arranged in various ways in relation to one another.

The way in which the electrical connector elements are arranged in relation to one another influences the formation of a plug-in face on the connection side in question. To be able to produce as compact as possible a design of an electrical plug-in connector formed according to the invention, in a further advantageous development of the invention a plurality of electrical connector elements is arranged on the housing body, in particular such that at least the first contact portions and/or the second contact portions of the plurality of connector elements are arranged one next to the other in a grid-like manner in at least one row, in particular in a plurality of rows, preferably in the manner of a matrix. On account of an arrangement in the manner of a matrix, the first or second contact portions of the plurality of connector elements are substantially equally mutually spaced, although deviations from equal spacing arise as a result of production/mounting tolerances.

Within the scope of the invention, underpopulation is also permissible, and a row therefore does not have to have a connector element at every position and free spaces in the row-like or matrix-like arrangement of the electrical connector elements are also permissible.

This also results in the advantage of simple production and reliable mutual spacing of the above-mentioned contact portions. In addition, an option advantageously arises in that the electrical connector elements can be arranged such that a compact design compact arrangement of the electrical connector elements is possible. The arrangement of the connector elements in relation to one another also includes the connector elements in a row and/or a being arranged in parallel with a plane.

Within the scope of the invention, in a variant the electrical connector elements are also arranged in respective chambers, as long as a plurality of electrical connector elements is provided.

In this regard, a further advantageous development of the invention is distinguished by a plurality of electrical connector elements which, when in an inserted position, are arranged on the housing body such that each electrical connector element is associated with one chamber.

This makes it possible, in a simple manner, for the individual connector elements not to touch one another. Galvanic separation of the electrical connector elements from one another is thus achieved in turn.

Within the scope of the invention, the connector elements may also be electrically interconnected to be able to apply the same electric potential to said elements, for example.

As has already been mentioned above, it is possible to provide the insertion opening on different sides of the housing body. To make the insertion as simple as possible, while providing reliable contactability, in a further advantageous development of the invention the side insertion opening is formed on a side of the housing body opposite the first or second connection side. In addition to the above-mentioned advantage, the housing body can thus also be kept small, which results in mounting advantages and means that the necessary mounting space can also be kept small. This results in further advantages for the handling of an electrical plug-in connector formed according to the invention.

To facilitate simple insertion of the electrical connector element, in an advantageous development of the invention the clamping slot extends longitudinally in an inserted position from the side insertion opening towards a first or second connection side of the housing body.

This makes it possible to place the electrical connector element, by means of the clamping slot, on the housing rib provided therefor by means of an, in particular exclusively, translational insertion movement, and the electrical connector element is therefore held in an inserted position on account of interaction between the clamping slot and the housing rib. In this respect, the housing body is configured and designed for inserting the electrical connector element into the chamber provided therefor by means of a translational insertion movement.

To facilitate simple insertion of the electrical connector element into the chamber, in a further advantageous development of the invention the clamping slot is distinguished in that it extends longitudinally when in an inserted position from the side insertion opening towards a first or second connection side of the housing body.

Within the scope of the invention, a longitudinal extension proceeds, when in an inserted position, in the direction from the side insertion opening towards one of the connection sides or analogously if the insertion opening is formed on a connection side.

Continuing with the above-mentioned advantages, in a further advantageous development of the invention the clamping slot opens into an outer edge of the electrical connector element, in particular of the connection portion, which results in both production and mounting advantages.

To concentrate the clamping force with which the clamping slot clampingly acts on the housing rib so as to hold the electrical connector element on the housing rib, and to thus increase the clamping action, in a further advantageous development of the invention a projection is formed on at least one delimiting edge of the clamping slot and projects into the clamping slot such that the projection presses on the housing rib in an inserted position. In addition to the above-mentioned advantage, this results in the further advantage that the electrical connector element is prevented from unintentionally detaching from the housing rib to an effective degree.

The contact portions of an electrical plug-in connector according to the invention may be designed in various ways. It is thus possible for a first or second electrical contact portion to be designed in the manner of a socket. It is also possible for the first or second contact portion to be each implemented as a clamping point for contacting.

In the light of this, in a further advantageous development of the invention at least the first electrical contact portion or the second electrical contact slot of the electrical connector element, or of at least one electrical connector element, is configured and designed to form a plug-in contact, in particular as a pin contact.

Accordingly, the invention also includes plug-in contacts or pin contacts being provided on both connection sides. The invention therefore also includes the variant whereby the first contact portion and the second contact slot are designed in the same manner.

This results in the advantage that it is possible to produce an accordingly designed contact portion in a simple manner. Likewise, this also results in cost and handling advantages.

When a contact portion of the electrical connector contacts a corresponding contact of a contact carrier, they are intended to be mutually aligned so as to apply them to one another for mutual contact. To achieve as precise as possible positioning of at least one of the electrical contact portions, in a further, advantageous development of the invention at least the first electrical contact portion or the second electrical contact portion of a connector element projects out of the chamber via a through-hole, in particular the particular contact portion being associated with a corresponding through-hole. Within the scope of the invention, the term "projects" is also understood to mean emerging at least in portions from the chamber.

The through-hole reduces the degree of freedom of movement radially with respect to the contact direction in which the contact carrier is applied to the electrical plug-in connector according to the invention such that they contact one another in the above-mentioned manner. The contact therebetween is thus made easier.

The invention thus leads to the advantage that the holding of the electrical connector element on the housing body takes place away from the through-hole. On account of the distribution of the functions, namely the positioning of the electrical connector element in relation to the first or second contact portion, and the hold resulting from the achieved clamping action between the clamping slot and the housing rib, the load on the housing body in the region of the through-hole is reduced and the retaining forces that are needed to hold the electrical connector element on the housing body are applied to the housing body away from the through-hole. This prevents the formation of stress cracks in the region of the through-hole; these cracks would make an electrical plug-in connector defective and it would no longer be usable as intended. The invention thus advantageously leads to scrapped parts being kept to a minimum.

The first and the second contact portion of an electrical connector element may have different designs and configurations.

This results in a very broad field of application for an electrical plug-in connector formed according to the invention.

In this connection, it is also intended within the scope of the invention to use an electrical plug-in connector according to the invention to form a printed circuit board terminal such that it can be configured and designed accordingly.

In the light of this, in a further advantageous development of the invention the housing body, together with the connection element, is configured and designed for mounting on a printed circuit board.

This also includes the connector element in question being configured and designed for mounting on the printed circuit board, thus making it possible to contact a contact formed on a printed circuit board for contacting a conductor track.

The advantage of this is that a printed circuit board terminal having the above-mentioned advantages can be produced by an electrical plug-in connector according to the invention.

In addition, a further advantageous development of the invention is distinguished in that the housing body, together with the electrical connector element, is configured and designed for mounting on a printed circuit board. It is thus possible for the electrical plug-in connector to be configured and designed to interconnect printed circuit boards and to form a printed circuit board connector.

For this purpose, the relevant first and/or second contact portion is preferably designed as a pin contact, as has been presented as an option above. The advantage of this is that the contacting by means of the pin contacts can take place by means of what is referred to as through-hole technology (THT) and by means of surface-mounting technology (SMT).

In this regard, it is possible for the pin contacts to be held in the housing body in the form of a pin strip, which housing body in turn positions the pins, as mentioned above, so as to be spaced apart in the manner desired for the plug-in connector. In this case, the housing body is preferably electrically insulating, preferably by using an electrically insulating material or an insulator.

To further simplify the assembly and parts logistics, in a further advantageous development of the invention the housing body is formed of an electrically insulating material or insulator in one piece and in particular at least in portions, or comprises electrically insulating material or an insulator.

An insulating material means that galvanic separation can be achieved not only on account of the mutual spacing of connector elements, but also by using an electrically insulating material, which may also be used for the housing body in portions.

For simple and space-saving contact redirection, in a further advantageous development of the invention the first electrical contact portion is arranged/designed at an angle, in particular so as to be transverse, preferably orthogonal, to the second contact portion. Accordingly, the connection sides may also be formed on the housing body at an angle to one another in this manner, in particular so as to be transverse, preferably orthogonal, to one another.

The invention also includes a printed circuit board comprising an electrical plug-in connector arranged thereon and having the above-described features. A printed circuit board formed according to the invention therefore benefits from the above-mentioned advantages of an electrical plug-in connector formed according to the invention.

In addition, in an advantageous development of the invention the electrical plug-in connector is electrically connected, in particular soldered, to at least one contact formed on the printed circuit board, in particular at least one conductor track contact, by means of the second electrical contact portion of said plug-in connector. Accordingly, the second electrical contact portion faces the printed circuit board.

The invention also includes a method for producing an electrical plug-in connector, as has been described above, comprising the steps of providing a housing body, providing a connection element, inserting an electrical connector element into a chamber in the housing body, the electrical connector element being inserted at least in portions into the chamber via a side insertion opening, and the electrical connector element being clampingly placed on a housing rib of the housing body by means of a clamping slot.

For this purpose, in addition to the above-described features of an electrical plug-in connector according to the invention, in an advantageous development of the method according to the invention at least the first electrical contact portion or the second electrical contact portion of the electrical connector element is designed as a pin contact and is inserted into the chamber such that at least the first or second electrical contact portion projects at least in portions out of the chamber via a through-hole, meaning that simplified positioning of the electrical connector element in the housing body is achieved.

Furthermore, in a further advantageous development of the method according to the invention, the connector element is inserted into the chamber by means of a translational insertion movement, meaning that the production processes can be made simple, which in turn results in cost advantages.

The invention will be described below in more detail with reference to the accompanying drawings, in which an embodiment of an electrical plug-in connector according to the invention is shown so as to represent a plurality of electrical plug-in connectors according to the invention for connecting contacts of a first contact carrier and of a second contact carrier.

In this description, all the features that are claimed, described and shown in the drawings form the subject matter of the invention, both in isolation and in any desired combination, irrespective of the summary of said features in the claims and the dependency references therein and irrespective of the description or depiction of said features in the drawings.

The figures in the drawings are schematic views of one possible embodiment of an electrical plug-in connector according to the invention.

The depictions in the drawings are therefore in particular not to scale, and therefore the scales selected in the drawings may also be or are different from one another. For better clarity, the depictions are reduced to the elements/components/parts that aid understanding. In the drawings, the same or corresponding components/parts or elements are provided with the same reference signs.

For better clarity, not all elements/components/parts are always provided with reference signs in the drawings; in this case, the signs are assigned on the basis of the same depiction or a depiction that has been adapted to the view in question.

For better clarity, the description below will be reduced to the differences between the embodiments or figures if the structure is the same or similar.

At the same time, the details of the embodiments shown in the drawings in relation to the features also supplement one another; the details in question therefore also apply collectively in an analogous manner to the different embodiments and further electrical plug-in connectors formed according to the invention. The invention is therefore not limited to the embodiments that are described and shown.

Furthermore, the embodiment of a modular electrical plug-in connector according to the invention will also be referred to using the term "plug-in connector" for short.

FIG. 1 is schematic side view of an embodiment of an electrical plug-in connector 2 according to the invention, in which view the housing body 4 and the electrical connector element 6 to be arranged thereon are separated from one another. An electrical connector element 6 will be also be referred to below as a connector element 4 for short.

On account of the selected view, two connector elements 6 are shown in FIG. 1; however, statements made below about a connector element 6 apply analogously to the further connector elements 6 and are also labeled with the same reference signs. However, the connector elements 6 here do not have to have an identical shape, as this embodiment shows.

The plug-in connector 2 is used to electrically interconnect contacts of a first contact carrier and of a second contact carrier.

This takes place by means of an electrical connector element 6 that is inserted, when in an inserted position, in a chamber 8 in a housing body 4. The insertion takes place such that the electrical connector element 6 forms, on a first connection side 10 of the housing body 4, a first electrical contact portion 12 (also referred to below as the first contact portion 12 for short) for plug-in connection to the contact of the first contact carrier and, on a second connection side 14 of the housing body 4, a second electrical contact portion 16 (also referred to below as the second contact portion 16 for short) for connection to the contact of the second contact carrier.

The connector element 6 here is inserted into the chamber 8 via a side insertion opening 18 when in an inserted position and comprises at least one clamping slot 22 for being held on the housing body 4, which slot is open towards an outer edge 20 of the connector element 6 and which is designed such that the connector element 6 is clampingly placed on a housing rib 24 (not visible in FIG. 1 on account of the selected view, but shown in FIG. 6) of the housing body 4 by means of the clamping slot 22. To clamp the clamping slot 22 on the housing rib 24, the clamping slot 22 and the housing rib 24 are formed so as to be geometrically matched to one another.

In an inserted position, the clamping slot 22 extends longitudinally from the side insertion opening 18 towards the first connection side 10 of the housing body 4, the side insertion opening 18 being formed on a side 11 of the housing body 4 opposite the first connection side 10.

The first electrical contact portion 12 is configured and designed to form a plug-in contact 13, which is in turn designed as a pin contact 13' in this embodiment of a plug-in connector 2.

Furthermore, the housing body 4, together with the electrical connector element 6, is configured and designed for mounting on a printed circuit board, the second contact portion 16 being configured and designed to contact at least one contact which is formed on a printed circuit board and is designed as a conductor track contact. For this purpose, in this embodiment the second contact portion 16 is designed analogously to the first electrical contact portion 12 as a plug-in contact 17/pin contact 17' that is inserted at least in portions in a recess in the printed circuit board so as to contact the corresponding printed circuit board track contact and is held thereon by means of a soldered connection.

Figure 2:
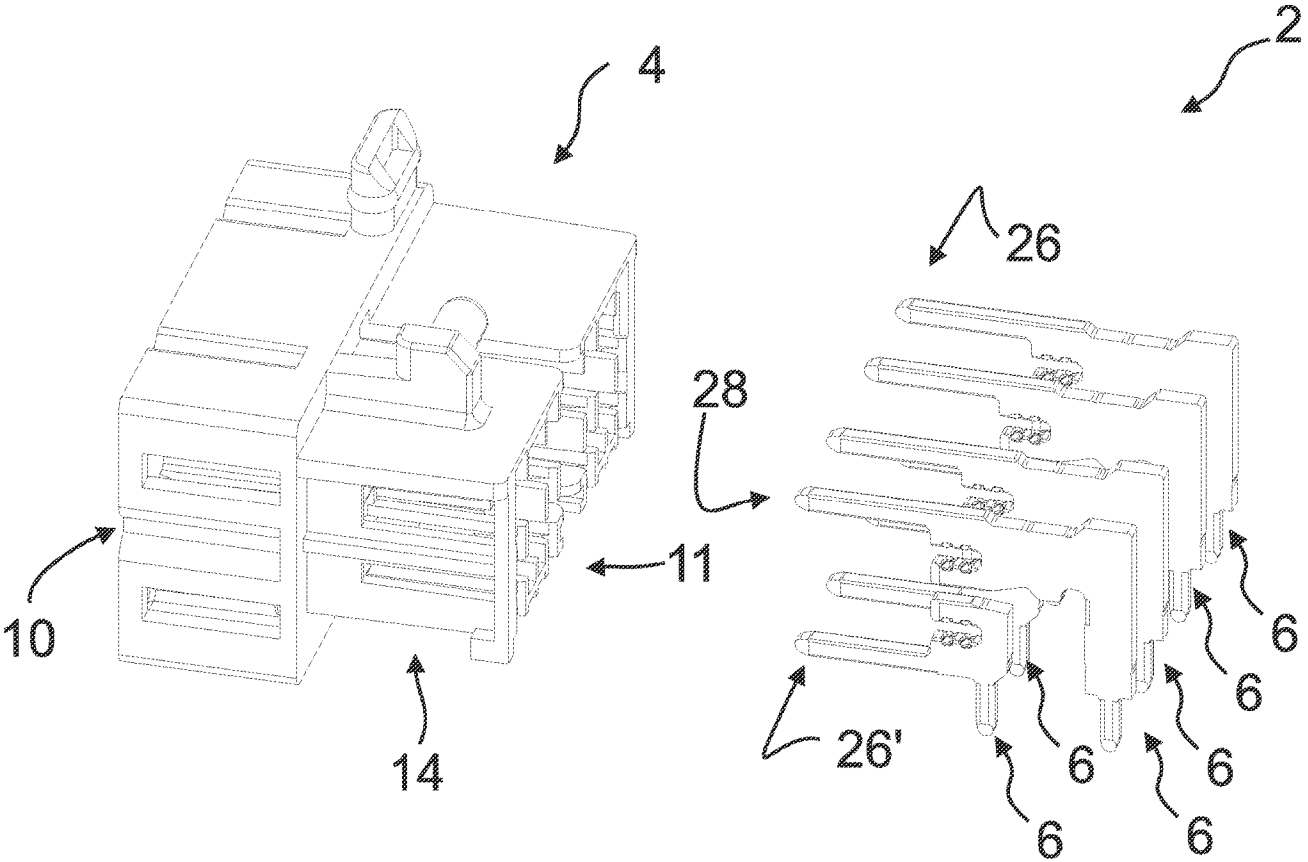
FIG. 2 is a schematic perspective view of the embodiment of an electrical plug-in connector according to the invention from FIG. 1, but in a size ratio that is different to that in FIG. 1.

FIG. 2 is a perspective view of the plug-in connector 2 from FIG. 1, which has a plurality of electrical connector elements 6 that are each designed as described above and are arranged on the housing body 4 such that each electrical connector element 6 is associated with one chamber 8. The connector elements 6 and the associated chambers 8 are each labeled with reference signs 6 and 8, respectively.

The connector elements 6 are arranged on the housing body 4 such that the first contact portions 12 (all labeled with reference sign 12) of the plurality of connector elements 6 are arranged one next to the other in mutually parallel rows 26, 26' in the manner of a matrix.

This results in a connection interface 28 for a contact carrier that is plugged in on the first connection side 10 to establish an electrical connection and, accordingly, has a connection interface for this purpose which has a complementary shape at least in portions.

Figure 3:
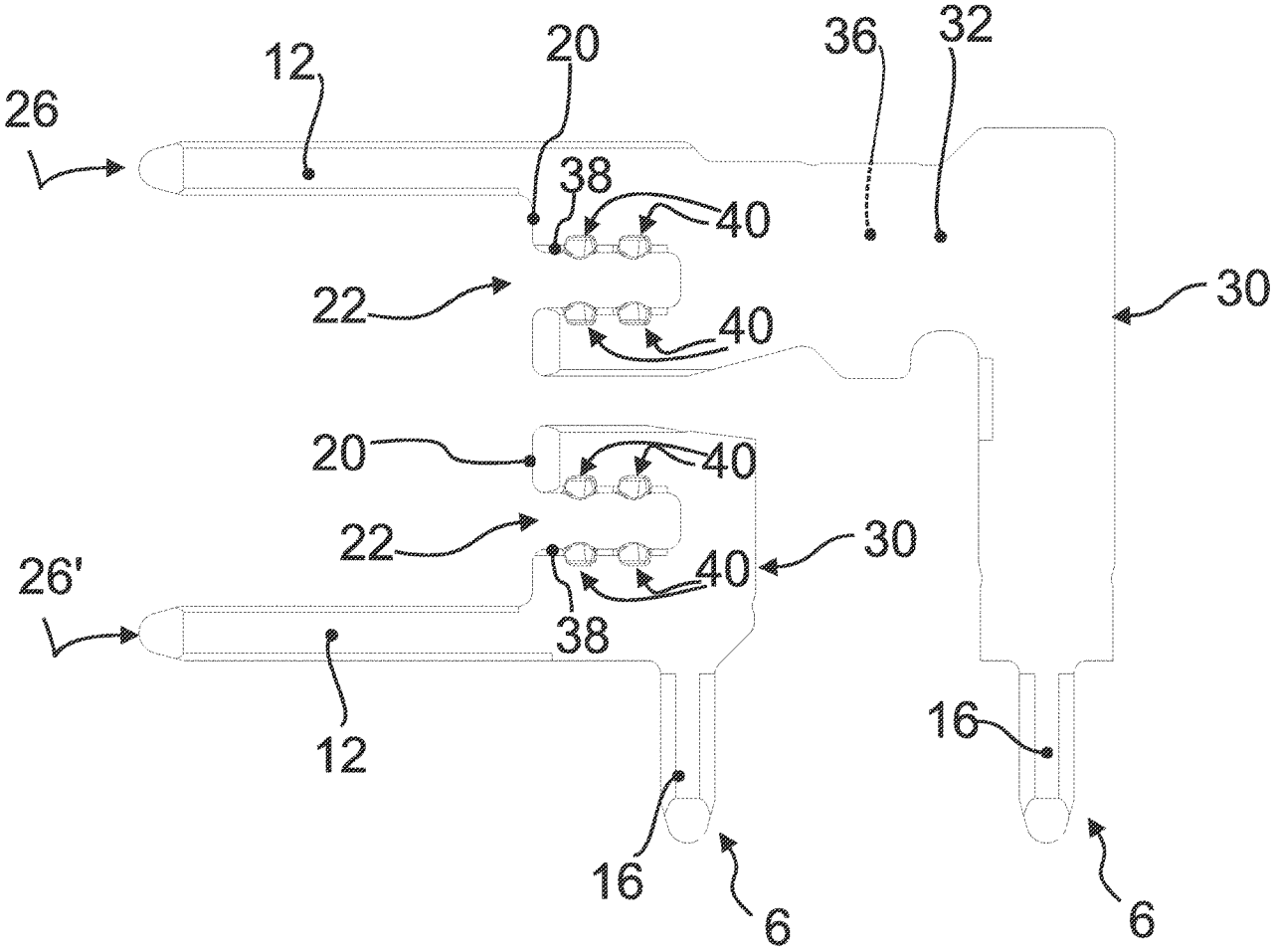
FIG. 3 is a schematic side view of the electrical connector element from the embodiment of an electrical plug-in connector according to the invention, which view corresponds to that in FIG. 1, FIG. 4 schematically shows the embodiment of an electrical plug-in connector according to the invention from FIG. 1 in a perspective view of the housing body, but in a size ratio that is different to that in FIG. 1.

FIG. 3 shows the connector element 6, in which the first contact portion 12 and the second contact portion 16 are interconnected by means of a sheet-like connection portion 30, the connector element 6 being formed in one piece and as a punched part made of electrically conductive sheet metal. The connector element 6 is therefore a flat component.

The first contact portion 12 is formed on the housing body 4 at an angle, and in this embodiment so as to be orthogonal, to the second contact portion 16. Accordingly, the first connection side 10 is also formed at an angle or so as to be orthogonal to the second connection side 14 of the housing body 4.

The clamping slot 22 is formed in the sheet-like connection portion 30 and passes through said portion from one sheet surface 32 to the opposite sheet surface 36 (concealed in FIG. 1 on account of the selected view).

Furthermore, the clamping slot 22 opens into an outer edge 20 of the connector element 24, which edge defines that of the sheet-like connection portion 30.

Figure 6:
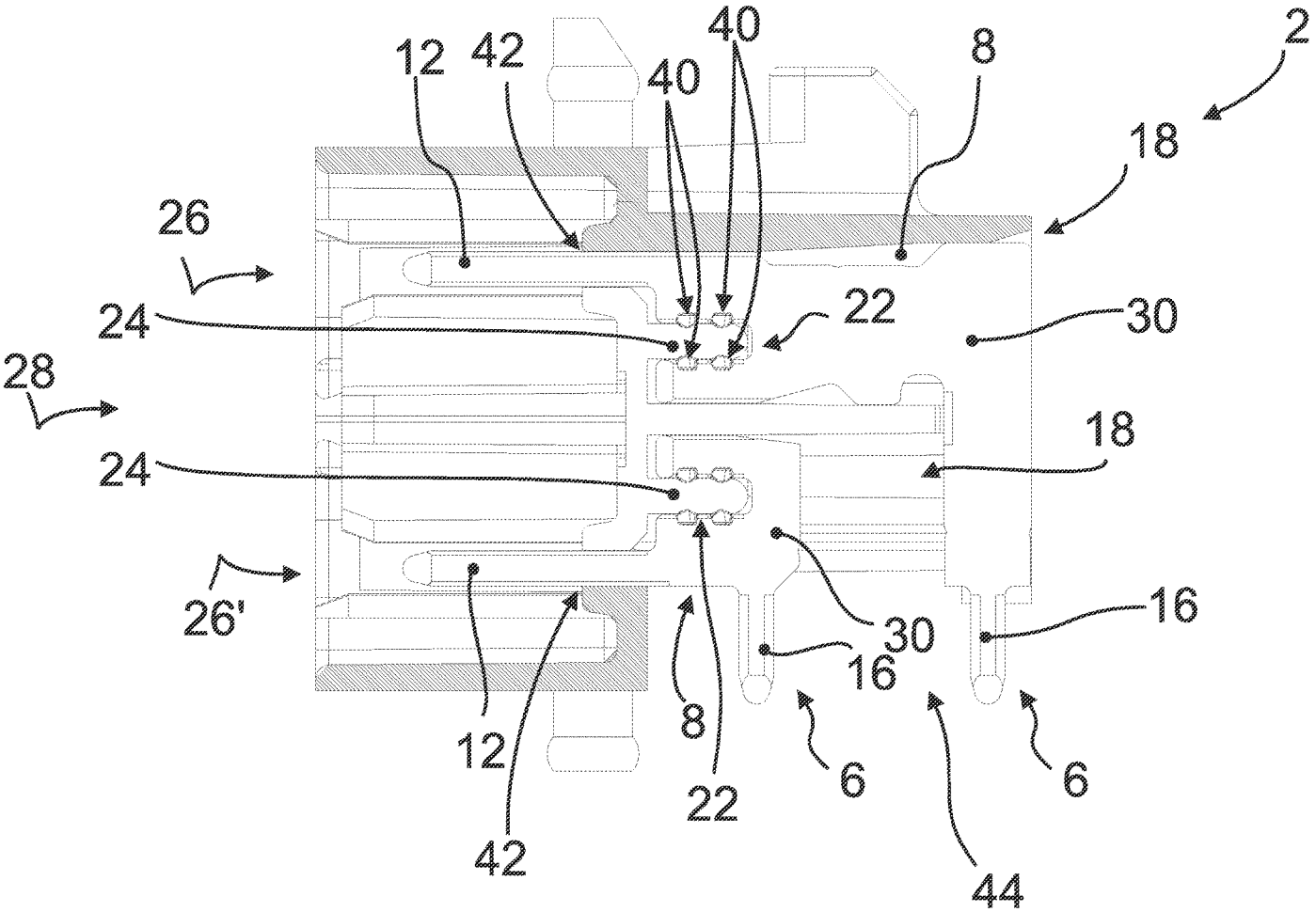
FIG. 6 shows the embodiment of an electrical plug-in connector according to the invention from FIG. 1 in a schematic sectional view labeled as C-C in FIG. 4, but in a size ratio that is different to that in FIG. 1 and in an inserted position as shown in FIG. 4.

FIG. 3 shows that at least one projection 40 is formed on a delimiting edge 38 of the clamping slot 22 and projects into the clamping slot 22 such that the projection 40 (each provided with the same reference sign) presses on the housing rib 24 when the electrical connector element 6 is in an inserted position, as can be seen in FIG. 6. Each projection 40 has been produced by shaping the connector element 6.

In this embodiment, a plurality of projections 40 (all labeled with reference sign 40) are arranged on the delimiting edge 38 and are associated with one another in corresponding pairs such that corresponding projections 40 are arranged opposite one another and press on the housing rib 24 on either side. The projections 40 here are preferably arranged so as to be aligned with one another in pairs such that the clamping forces thereof act in a common line or straight line.

Figure 4:
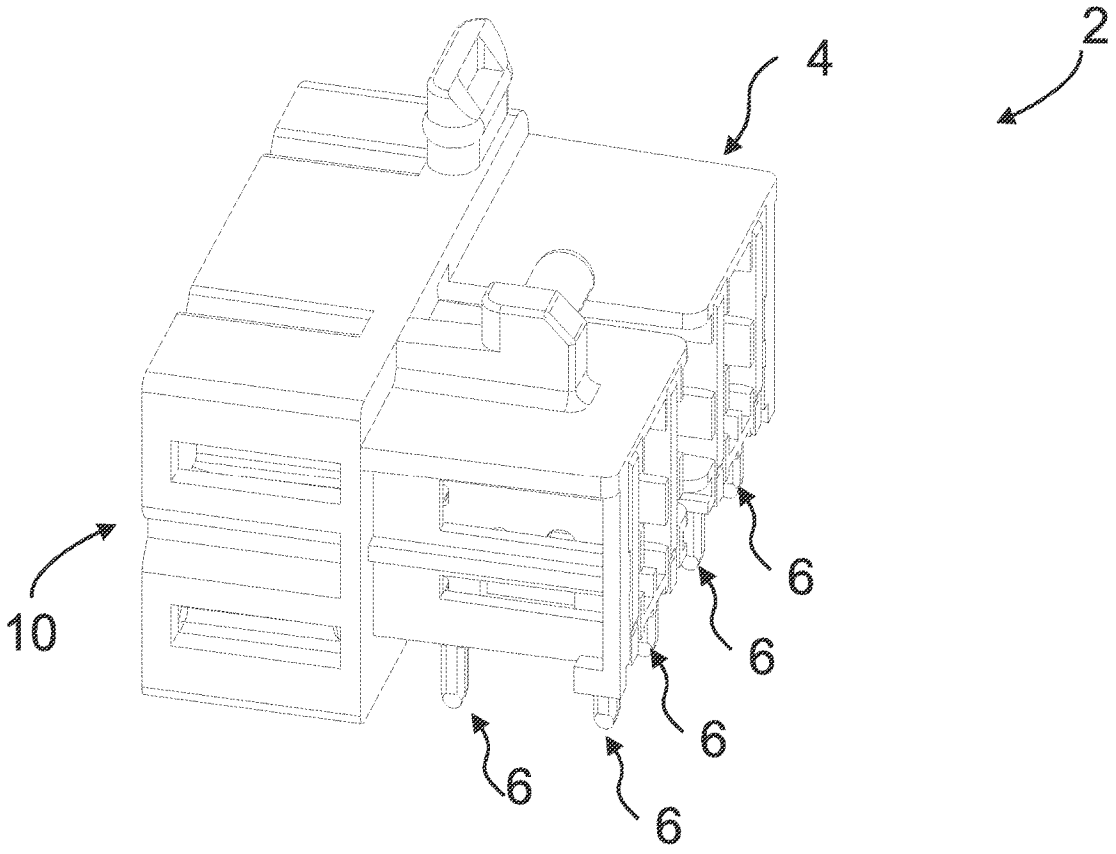

FIG. 4 shows the housing body 4, which is formed in one piece and of an electrically insulating material. A plastics material having corresponding insulating properties was selected as the electrically insulating material; the housing body 4 is therefore cheap to produce by means of an injection-molding method.

Figure 5:
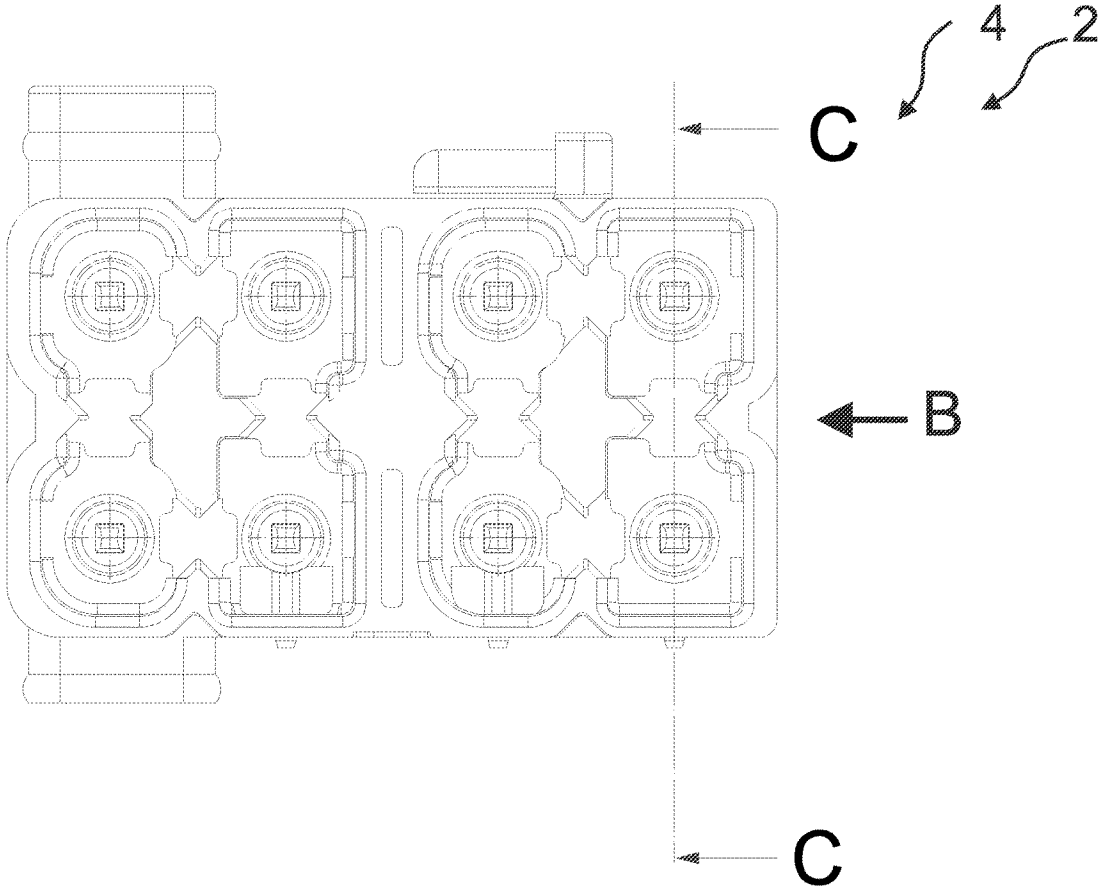
FIG. 5 shows the embodiment of an electrical plug-in connector according to the invention from FIG. 1 in a schematic side view that is labeled as A in FIG. 1, but in a size ratio that is different to that in FIG. 1 and in an inserted position in which the above-mentioned plug-in connector has been ready-fitted with electrical connector elements.

FIG. 5 shows the arrangement of the connector elements 6 in relation to one another on the housing body 4, the first contact portions 12 of which connector elements—as already mentioned—are arranged on the housing body 4 in a grid-like manner in an arrangement having two rows 26, 26'. The rows 26, 26' are oriented in parallel with one another. To produce this row arrangement, the connector elements 6 that are associated with a common row 26, 26' are arranged in parallel with one another, said connector elements being arranged one next to the other in parallel in relation to the particular sheet surfaces 32 or the opposite sheet surfaces 36 thereof. The individual chambers 8 in this arrangement follow the electrical connector elements 6; as a result, electrical short circuits therebetween are eliminated to an effective degree.

It can be seen in FIG. 6 that the first contact portion 12 of each connector element 6 projects out of the chamber 8 through an individual through-hole 42 associated with the connector element 6.

To insert the connector element 6 into the individual chamber 8 in the housing body 6, the opening 44 through which the second contact portion projects out of the chamber is slot-shaped and is open towards the plug-in opening. This makes it possible in a simple manner to insert the connector element 6 into the corresponding chamber 8 by means of a translational insertion movement.

Figure 7:
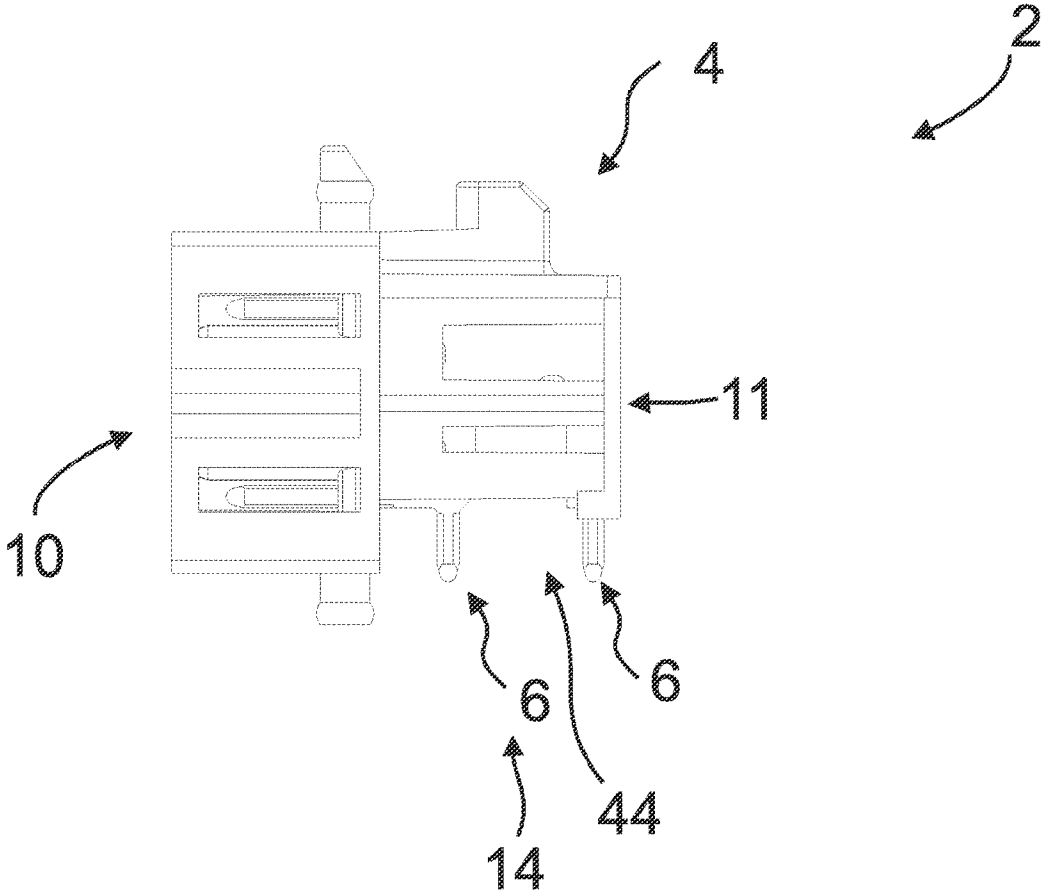
FIG. 7 shows the embodiment of an electrical plug-in connector according to the invention from FIG. 1 in a schematic side view labeled as B in FIG. 5, in an inserted position as shown in FIG. 5.

FIG. 7 shows the inserted position on the basis of the above-described embodiment of an electrical plug-in connector 2 according to the invention in a side view labeled as B in FIG. 5.

The drawings also show a method according to the invention for producing an electrical plug-in connector 2, comprising the steps of providing a housing body 4, providing a connection element 6, inserting the electrical connector element 6 into a chamber 8 in the housing body 4, and inserting the electrical connector element 6 into the chamber 8 via a side insertion opening 18, the particular electrical connector element 6 being clampingly placed on a housing rib 24 of the housing body 4 by means of a clamping slot 22.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS electrical plug-in connector 2
housing body 4
electrical connector element 6
chamber 8
first connection side 10
opposite side 11
first contact portion 12
plug-in contact 13
pin contact 13'
second connection side 14
second contact portion 16
plug-in contact 17
pin contact 17'
insertion opening 18
outer edge 20
clamping slot 22
housing rib 24 rows 26, 26'
connection interface 28
sheet-like connection portion 30
sheet surface 32
opposite sheet surface 36
delimiting edge 38
projection 40
through-hole 42
opening 44

The invention claimed is:

1. An electrical plug-in connector for interconnecting contacts of a first contact carrier and of a second contact carrier, comprising:

an electrical connector element that is inserted in a chamber in a housing body when in an inserted position, such that the electrical connector element forms, on a first connection side of the housing body, a first electrical contact portion for plug-in connection to the contact of the first contact carrier and, on a second connection side of the housing body, a second electrical contact portion for connection to the contact of the second contact carrier, wherein the electrical connector element is inserted at least in portions into the chamber via a side insertion opening when in the inserted position and comprises at least one clamping slot for being held on the housing body, which clamping slot is open towards an outer edge of the electrical connector element, which outer edge is on a side of the electrical connector element from which the first electrical contact portion extends longitudinally, the clamping slot being configured such that the electrical connector element is clampingly placed on a housing rib of the housing body by the clamping slot.

2. The electrical plug-in connector according to claim 1, wherein the first electrical contact portion and the second electrical contact portion are interconnected by a sheet-like connection portion.

3. The electrical plug-in connector according to claim 1, wherein the electrical connector element comprises a one-piece punched part comprised of an electrically conductive metal.

4. The electrical plug-in connector according to claim 2, wherein the clamping slot is formed in the sheet-like connection portion.

5. The electrical plug-in connector according to claim 1, further comprising a plurality of electrical connector elements arranged on the housing body when in the inserted position such that each electrical connector element is associated with one chamber.

6. The electrical plug-in connector according to claim 1, further comprising a plurality of electrical connector elements arranged on the housing body such that first contact portions and/or second contact portions of the plurality of connector elements are arranged one next to the other in a grid-like manner in at least one row.

7. The electrical plug-in connector according to claim 1, wherein at least two connector elements are arranged in a common insertion plane in the receiving chamber when in the inserted position.

8. The electrical plug-in connector according to claim 1, wherein the side insertion opening is formed on a side of the housing body opposite the first or second connection side.

9. The electrical plug-in connector according to claim 1, wherein the clamping slot opens into the outer edge of the electrical connector element.

10. The electrical plug-in connector according to claim 1, further comprising a projection formed on at least one delimiting edge of the clamping slot, which projection projects into the clamping slot such that the projection is configured to press on the housing rib when the electrical connector element is in the inserted position.

11. The electrical plug-in connector according to claim 1, wherein at least the first electrical contact portion or the second electrical contact portion comprises a plug-in contact.

12. The electrical plug-in connector according to claim 1, wherein at least the first electrical contact portion or the second electrical contact portion of the electrical connector element projects out of the chamber via a through-hole.

13. The electrical plug-in connector according to claim 1, wherein the housing body, together with the electrical connector element, is configured to be mounted on a printed circuit board.

14. The electrical plug-in connector according to claim 1, wherein at least the second electrical contact portion is configured to contact at least one contact formed on a printed circuit board.

15. The electrical plug-in connector according to claim 1, wherein the housing body is comprised of an electrically insulating material or insulator in one piece and/or at least in portions, or is comprised of an electrically insulating material or an insulator.

16. The electrical plug-in connector according to claim 1, wherein the first electrical contact portion is arranged at an angle so as to be transverse to the second contact portion.

17. A printed circuit board comprising:

the electrical plug-in connector according to claim 1 arranged thereon.

18. The printed circuit board according to claim 17, wherein the electrical plug-in connector is electrically connected to at least one contact formed on the printed circuit board by the second electrical contact portion of the plug-in connector.

19. A method for producing the electrical plug-in connector according to claim 1, comprising the following steps:

providing the housing body;

providing the electrical connection element; and inserting the electrical connector element into the chamber in the housing body, wherein the electrical connector element is inserted into the chamber via the side insertion opening, the electrical connector element being clampingly placed on the housing rib of the housing body by the clamping slot.

20. The method according to claim 19, wherein at least the first electrical contact portion or the second electrical contact portion of the electrical connector element comprises a pin contact, and the electrical connector element is inserted into the chamber such that the pin contact projects at least in portions out of the chamber by a through-hole.

21. The method according to claim 19, wherein the electrical connector element is inserted into the chamber by a translational insertion movement.

* * * * *